United States Patent [19]

Renz

[11] 4,328,596

[45] May 11, 1982

[54] WATER CLOSET FLUSHING VALVE

[76] Inventor: George H. Renz, 255 Norman Dr., Ramsey, N.J. 07446

[21] Appl. No.: 117,366

[22] Filed: Jan. 31, 1980

Related U.S. Application Data

[63] Continuation of Ser. No. 866,593, Jan. 3, 1978, abandoned, which is a continuation of Ser. No. 815,318, Jul. 13, 1977, abandoned.

[51] Int. Cl.[3] ..... E03D 1/14; E03D 3/12

[52] U.S. Cl. ..... 4/324; 4/325; 4/326; 4/327; 4/415

[58] Field of Search ..... 4/324–327, 4/400, 396–399, 401

[56] References Cited

U.S. PATENT DOCUMENTS

| | | | |
|---|---|---|---|
| 2,511,545 | 6/1950 | Roselair | 4/327 |
| 2,602,934 | 7/1952 | McCormack et al. | 4/324 |
| 2,602,934 | 7/1952 | McCormack et al. | 4/324 |
| 2,705,808 | 4/1955 | Crockett | 4/400 |
| 2,709,263 | 8/1955 | Doty | 4/327 |
| 2,716,242 | 8/1955 | Robinson | 4/327 |
| 2,760,206 | 8/1956 | Loyd | 4/327 |
| 2,787,793 | 4/1957 | Crockett | 4/400 |
| 3,005,206 | 10/1961 | Dollinger | 4/327 |
| 3,049,721 | 8/1962 | Taylor | 4/395 |
| 3,151,337 | 10/1964 | Deniz | 4/327 |
| 3,869,733 | 3/1975 | White | 4/327 |
| 3,939,507 | 2/1976 | Clark | 4/327 |

*Primary Examiner*—Henry K. Artis

[57] ABSTRACT

My invention relates to a fail-safe automatic valve mechanism for water closets.

This system may be operated to drain the tank either partially or completely with particular emphasis on operation of either partial or complete flushing. Previous systems have been designed where the partial flush has no definite indent or feel for the partial flush mode, making it difficult or almost impossible to select the desired flush. The magnetic trigger assembly of my invention gives positive feel to the partial flush mode, as hereinafter described.

1 Claim, 5 Drawing Figures

FIG. 1
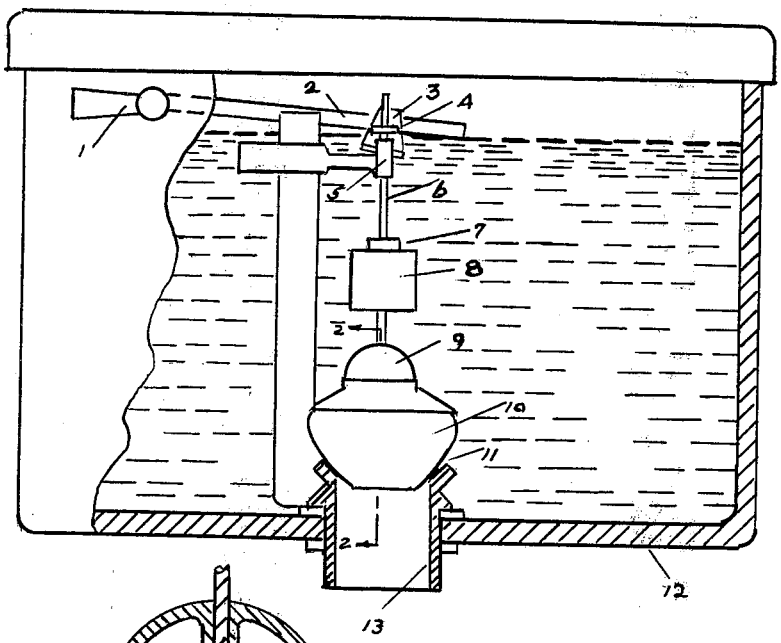
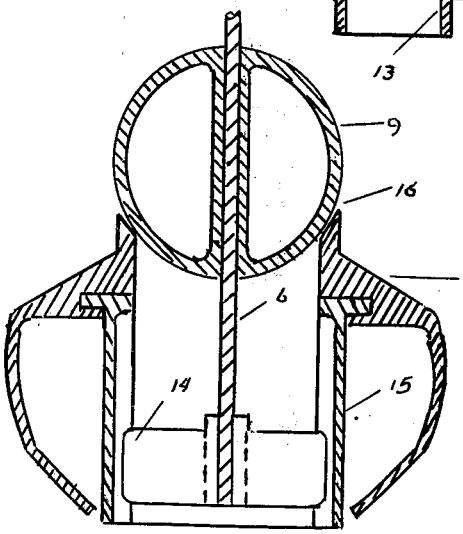
FIG. 2
FIG. 3
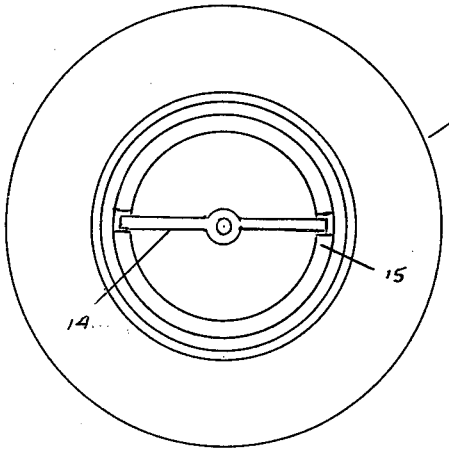

WATER CLOSET FLUSHING VALVE

This application is a Continuation-In-Part of Application Ser. No. 866,593, filed Jan. 3, 1978 and now abandoned which is a Continuation of Application Ser. No. 815,318 filed July 13, 1977 and now abandoned.

BRIEF DESCRIPTION OF THE DRAWINGS

FIG. 1 is a partially cut-away cross-sectional view of a conventional water closet tank incorporating the device of this invention.

FIG. 2 is a cross-sectional view taken along line 2—2 of FIG. 1 showing the combined float valve and ball-cock assembly of this invention.

FIG. 3 is a bottom view of the ball-cock assembly showing the base lifting bracket in position.

DESCRIPTION OF THE PREFERRED EMBODIMENTS

Figure 4:
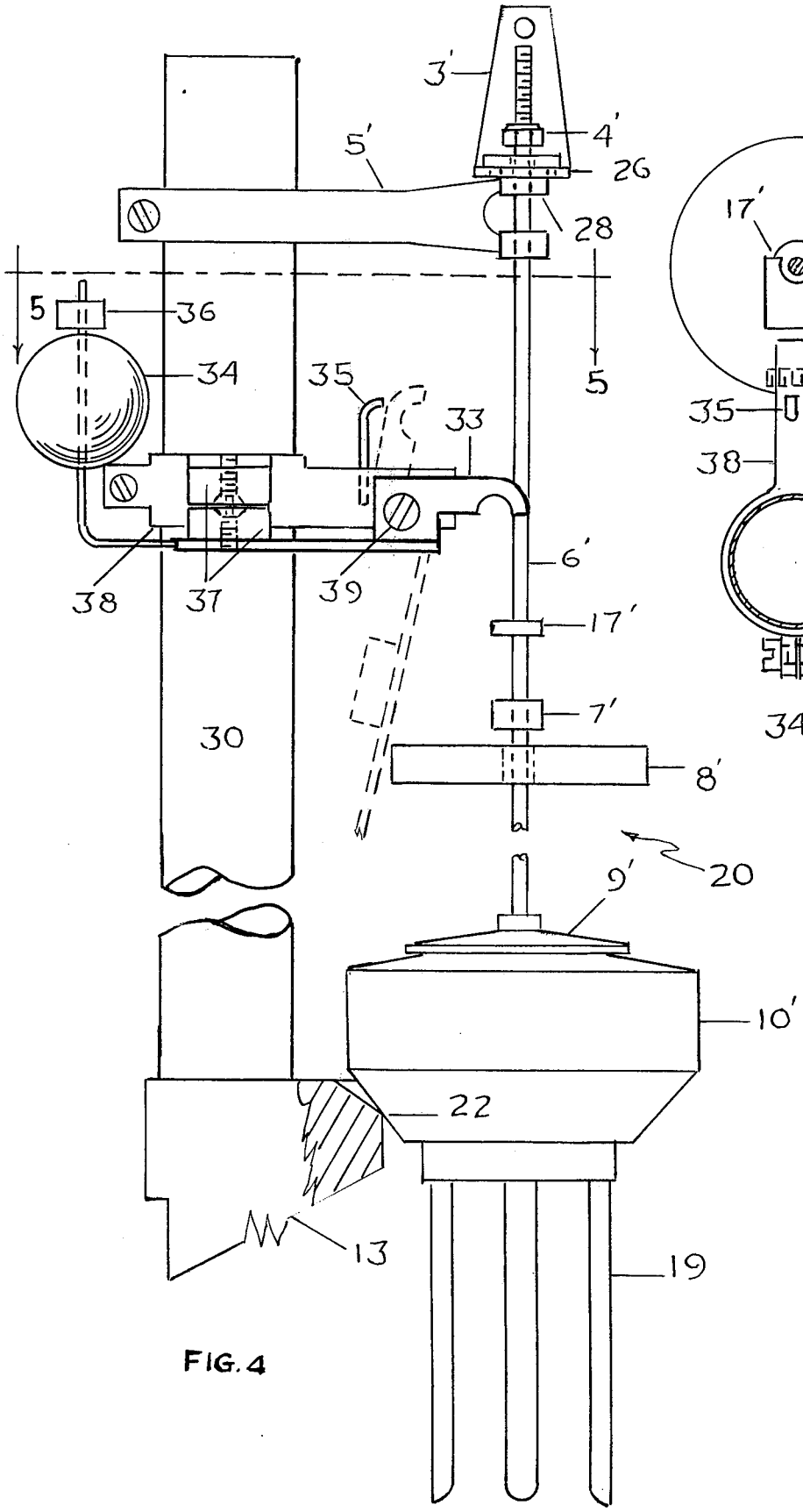
FIG. 4 is a front view of an alternative embodiment of the invention of FIG. 1.
Figure 5:
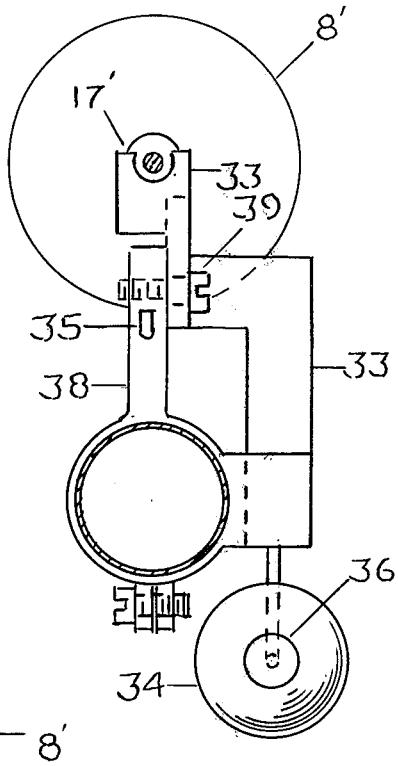
FIG. 5 is a top and side view of FIG. 4 showing the addition of the magnetic trigger assembly.
Figure 4:
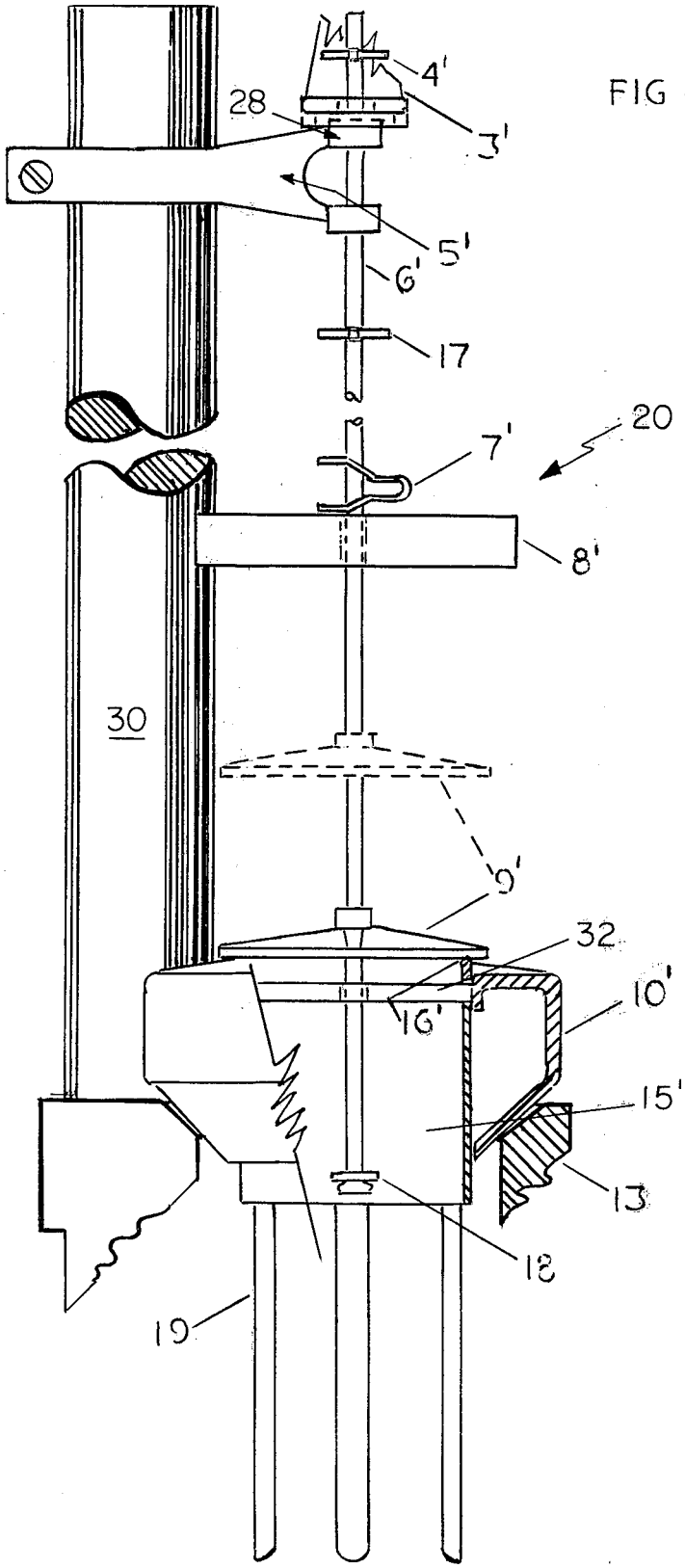

Referring now to the drawings, wherein like reference numerals refer to like parts in the several views. FIG. 1 illustrates a conventional water closet holding tank 12 with water closet flushing valve 20 installed therein. A conventional operating handle 1 is connected to a conventional operating lever 2 which actuates a lifting bracket 3' which is pendulous and pivotally secured to actuating lever 2. Lifting bracket 3' serves to raise lifting stem 6' as hereinafter described which stem 6' serves as the central assembly member of the flushing valve 20 of this invention, and extends vertically within holding tank 12.

In operation, when conventional operating handle 1 is partially depressed, actuating lever 2 moves upward, raising pendulous lifting bracket 3' and causing it to engage adjustable nut 4' on lifting stem 6', thus raising lifting stem 6' vertically. The raising of lifting stem 6' causes cap 9' to be raised off its valve seat 16' and water to flow through sleeve 15' in ball-cock 10' and downward through discharge fitting 13.

The upper limit for a partial flush is restricted when fixed collar 17' contacts the magnetic trigger assembly 33 which is pivotally mounted on bracket 38 by the shoulder screw 39. Due to the powerful flux density of magnets 37 together with the upward pressure of the float 34, a definite stop to collar 17' is obtained thus eliminating any overriding of collar 17' which could allow the lifting stem 6' to be raised into a full-flush mode. A stop finger 35 is mounted on bracket 38 to hold magnetic trigger assembly 33 clear of float 8' during operation. The prime function of float 34 which is an integral part of the magnetic trigger assembly 33 is to re-cock the magnetic trigger assembly 33 after it has gone through a full flush cycle; it also augments the holding action of the magnetic trigger assembly 33 during the partial flush mode. Collar 36 which is mounted frictionally on the vertical rod member of the magnetic trigger assembly 33 and may be raised or lowered to compensate for various tank water levels.

When a full flush is desired, the operating handle 1 must be fully depressed by applying additional pressure to overpower the magnetic trigger assembly 33 at which time the complete ball-cock assembly 10 will raise from its seat 22 as described heretofore.

After the full flush has been completed, replacement water will fill the tank causing float 34 to raise, thereby moving magnetic trigger assembly 33 into its cocked position for the next cycle.

FIG. 4 illustrates an alternate embodiment of flushing valve. In this embodiment, a modified ball-cock 10' having a central sleeve 15' is seated in discharge fitting 13. A modified lifting stem 6' has a terminal washer 18. Lifting stem 6' extends vertically upward through ball-cock 10', the upward limit of its vertical movement being determined by a horizontal rod 32 secured within sleeve 15'. A cap 9', rigidly secured to lifting stem 6' covers the top of sleeve 15' in ball-cock 10'. A mid-float 8' is loosely fitted about stem 6' and is limited in its upward vertical movement by adjustable collar 7' which is user-adjustable and controls the quantity of water to be discharged in a partial flush. A fixed collar 17' is rigidly secured to lifting stem 6' and limits the upward movement of lifting stem 6' when it contacts the bottom of mounting bracket 5' which is secured to the overflow pipe 30 so that the centralizing guide fins 19 which is an integral part of sleeve 15' extending vertically downward into discharge pipe 13 which insures positive alignment of ball-cock 10' in its valve seat 22.

These fins are within the confines of outlet fitting 13 at all times to provide positive seating of the ball-cock 10'.

In operation, when handle 1 is partially depressed, it causes actuating lever 2 to move upward, raising lifting bracket 3' to engage adjustable nut 4', thus raising lifting stem 6' vertically. The upward movement of lifting stem 6' causes cap 9' to rise off its seat 16', thus permitting a discharge of water through sleeve 15'. When the water level for a partial flush descends below the level of adjustable collar 7', mid-float 8' also descends allowing stem 6' to carry cap 9' downward, resulting in the seating of cap 9'; thereby completing the partial flush. If operating handle 1 is fully depressed, washer 18 at the base of lifting stem 6' will engage rod 32, causing ball-cock 10' to rise off its seat 22, resulting in a full flush.

Having described my invention, what I claim and desire to secure by Letters Patent is:

1. A valve mechanism for a water closet tank having a centrally disposed lifting stem attached thereto and a washer fixedly attached to the upper end thereof, a operating handle, an actuating level, an overflow pipe and a discharge outlet comprising:

a ball-cock valve member engageable around its perimeter in fluid-tight contact with a first valve seat on the top of said discharge outlet;

said ball-cock valve member having a centrally disposed large vertical sleeve which at its lower and communicates with said discharge outlet, a second valve seat at the upper end of said sleeve;

said vertical bore having guide-fins centered at its lower end in said sleeve;

said vertical bore having guide-fins centered at its lower end in said discharge outlet, a disk-like rubber cap permanently fixed on said vertical lifting stem in fluid-tight contact with said upper valve seat;

a vertically moveable float slidably disposed above said second valve on said lifting stem;

a collar frictionally and adjustably disposed above said float on said lifting stem, said collar serving as an upper stop relative to the vertical movement of said float;

a guide bracket secured to said overflow pipe and having a vertically oriented sleeve to guide the vertical movement of said lifting stem;

a pivotal lifting bracket secured to said actuating lever and engaged with said lifting stem via said washer;

a magnetic trigger assembly pivotally mounted on said overflow pipe, said magnetic trigger assembly having two permanent magnets comprised therein;

said magnetic trigger assembly actuatable by the adjustable collar upon depression of the operating handle, said adjustable collar being restricted in movement by the flux density of said magnets whereby a semi-flush is provided, and whereby a full flush is provided when the operating handle is depressed further to overcome the resistance of the magnetic flux whereby the lifting stem, together with the adjustable collar will continue to rise so as to break the magnetic attraction and buoyancy of the float member.

* * * * *